US005832559A

United States Patent [19]

Kang

[11] Patent Number: 5,832,559

[45] Date of Patent: Nov. 10, 1998

[54] MULTIPURPOSE AUXILIARY BRUSH FOR A VACUUM CLEANER

[75] Inventor: Sang-Bo Kang, Incheon, Rep. of Korea

[73] Assignee: Daewoo Electronics Co., Ltd., Rep. of Korea

[21] Appl. No.: 763,448

[22] Filed: Dec. 11, 1996

[30] Foreign Application Priority Data

Dec. 29, 1995 [KR] Rep. of Korea ..... 95-65218

[51] Int. Cl.[6] ..... A47L 9/02; A47L 9/06

[52] U.S. Cl. ..... 15/416; 15/398; 15/420

[58] Field of Search ..... 15/363, 393, 398, 15/402, 415.1, 416, 420

[56] References Cited

U.S. PATENT DOCUMENTS

| | | | |
|---|---|---|---|
| 4,723,338 | 2/1988 | Otsubo . | |
| 5,452,493 | 9/1995 | Galindo . | |
| 5,502,870 | 4/1996 | Ragner et al. | 15/398 |
| 5,621,946 | 4/1997 | Lee | 15/398 |

FOREIGN PATENT DOCUMENTS

| | | |
|---|---|---|
| 0 679 363 | 11/1995 | European Pat. Off. . |
| 96-13305 | 5/1996 | Rep. of Korea . |
| 1033467 | 6/1966 | United Kingdom . |

*Primary Examiner*—Terrence Till

*Attorney, Agent, or Firm*—Cushman Darby & Cushman Intellectual Property Group of Pillsbury Madison & Sutro, LLP

[57] ABSTRACT

Disclosed is a multipurpose auxiliary brush for complementing a cleaning function of a main brush and for enabling a vacuum cleaner to perform various cleaning jobs, regardless of an object and place to be cleaned. A knife-type brush of the multipurpose auxiliary brush is adapted to clean a recessed surface such as a doorframe, a windowframe, or a recessed place in a room. The multipurpose auxiliary brush is mounted to a hose assembly of the vacuum cleaner through an end of the knife-type brush. A haired brush of the multipurpose auxiliary brush is adapted to clean a recessed cleaning surface on which dust or other foreign substances has piled up, such as a doorframe, a windowframe, or a recessed place in a room. The haired brush is slideably positioned on a first portion of the knife-type brush. A plurality of hairs made of a synthetic thread are attached to an end of the haired brush. A carpet cleaning brush of the multipurpose auxiliary brush is adapted to beat and clean a variety of indented cleaning surfaces such as a sofa, a carpet, or a foot board made of woven goods. The carpet cleaning brush is slideably positioned on the haired brush. The carpet cleaning brush can protrude ahead of the front portion of the knife-type brush and can be arranged in a fan shape.

20 Claims, 9 Drawing Sheets

MULTIPURPOSE AUXILIARY BRUSH FOR A VACUUM CLEANER

BACKGROUND OF THE INVENTION

1. Field of the Invention

The present invention relates to a multipurpose auxiliary brush for a vacuum cleaner, and more particularly to a multipurpose auxiliary brush for complementing a cleaning function of a main brush in a vacuum cleaner so that a user can perform various cleaning jobs by using the vacuum cleaner, regardless of an object and place to be cleaned.

2. Description of the Prior Art

A variety of vacuum cleaners for easily removing dust or other foreign substances piled up on furniture, a floor, or a carpet in a room have been proposed hitherto. Generally, vacuum cleaners can be classified into canister-type vacuum cleaners and upright-type vacuum cleaners.

A canister-type vacuum cleaner includes a body mounted on wheels and a hose assembly for sucking dust or other foreign substances into the body. A suction generating means such as a suction fan, a motor for driving the suction generating means, and a disposable dust container for filtering dust or other foreign substances from air sucked by the vacuum cleaner, are positioned in the body. A main brush and a suction nozzle are provided at a free end of the hose assembly.

An upright-type vacuum cleaner has a similar constitution to that of the canister-type vacuum cleaner. However, the upright-type vacuum cleaner differs in that it vacuums a surface directly beneath its body, so a hose assembly is not required.

These days, the canister-type vacuum cleaner is more frequently used in the home than the upright-type vacuum cleaner.

FIG. 8 illustrates a canister-type vacuum cleaner 100. Vacuum cleaner 100 includes a floor cleaning unit 110, a canister unit 120, and a hose assembly 130 extending between floor cleaning unit 110 and canister unit 120.

Floor cleaning unit 110 includes a main brush (not shown) or a suction nozzle (not shown), and the like. Floor cleaning unit 110 is detachably connected to hose assembly 130. Hose assembly 130 comprises a rigid wand 132 and a flexible hose 134, and is pneumatically connected to a dust collecting compartment (not shown) of canister unit 120 by a suction hose connector 136.

Canister unit 120 mainly includes a hood 122, a cover 124 and a body 126. Hood 122 encloses the dust collecting compartment and is pivotally installed onto body 126 so as to open and close the dust collecting compartment. Further, hood 122 is also provided with a transparent window 128 for notifying the user of the dust collecting state. Cover 124 encloses a motor compartment (not shown) where an electric motor and a suction fan driven by the electric motor are positioned.

When a user wants to clean a flat bottom surface such as a floor by using vacuum cleaner 100 described above, the user slideably moves floor cleaning unit 110, to which a main brush and a suction nozzle are installed, on the surface to be cleaned. However, when the user want to clean a non-flat surface such as a doorframe, a windowframe, a corner of a room, furniture such as a carpet, etc., or a foot board made of woven goods, a plurality of auxiliary brushes are used instead of floor cleaning unit 110, to which the main brush is installed.

FIGS. 9A to 11B illustrate conventional representative auxiliary brushes.

First, FIGS. 9A and 9B illustrate a knife-type brush 10. Knife-type brush 10 is adapted to clean a recessed surface, on which it is difficult to slideably move floor cleaning unit 110. That is, knife-type brush 10 is adapted to clean a recessed surface such as a doorframe, a windowframe, or a corner of a room.

A first end 12 of knife-type brush 10 is fitted onto rigid wand 132 of hose assembly 130. A second end 14 of knife-type brush 10 has a sharply-slanted tip shape so that second end 14 can easily come into tight contact with the recessed surface. As illustrated in FIG. 11B, knife-type brush 10 includes a through opening 16 formed through an interior of knife-type brush 10 in the longitudinal direction. Through opening 16 is a passageway for air in the atmosphere to flow into vacuum cleaner 100.

FIGS. 10A and 10B illustrate a haired brush 20. Haired brush 20 is adapted to clean a recessed surface on which dust or other foreign substances has piled up, such as a doorframe, a windowframe, or a corner of a room. Haired brush 20 includes a brush head 22 and a hollow brush holder 24. A plurality of hairs 26 made of a synthetic thread is attached to brush head 22. A central opening 28 is formed in brush head 22. Central opening 28 is a passageway for air in the atmosphere to flow into vacuum cleaner 100. Brush head 22 is pivotally mounted to rigid wand 132 of hose assembly 130 at a certain angle by brush holder 24.

FIGS. 11A and 11B illustrate a carpet cleaning brush 30. Carpet cleaning brush 30 is adapted to beat and clean a variety of indented surfaces such as a sofa, a carpet, or a foot board made of woven goods. A first end 32 of carpet cleaning brush 30 is fitted onto rigid wand 132 of hose assembly 130. A second end 34 of carpet cleaning brush 30 has a polygon shape enlarged to have a large contact surface with the indented surfaces. As shown in FIG. 13B, carpet cleaning brush 30 includes a through opening 36 formed through an interior of carpet cleaning brush 30 in the longitudinal direction. Through opening 36 is a passageway for air in the atmosphere to flow into vacuum cleaner 100.

Hereinbelow, operations of the conventional multipurpose auxiliary brushes having the above described constitution will be briefly described.

Generally, when the user of vacuum cleaner 100 cleans a flat surface such as a floor by using vacuum cleaner 100, the user performs a cleaning job by slideably moving floor cleaning unit 110 on the flat surface.

However, when the user cleans a recessed surface such as a doorframe, a windowframe, or a corner of a room, the user uses knife-type brush 10 as an auxiliary brush. For this purpose, the user of vacuum cleaner 100 separates floor cleaning unit 110 from rigid wand 132 of hose assembly 130 and inserts knife-type brush 10 onto rigid wand 132. Thereafter, the user brings knife-type brush 10 having a sharped tip into contact with the recessed surface and cleans dust or other foreign substances piled up on the recessed surface. Thereby, dust or other foreign substances released from the recessed surface by knife-type brush 10 is sucked into the dust collecting compartment of vacuum cleaner 100.

Meanwhile, when the user cleans a recessed surface on which dust or other foreign substances had been pile up such as a doorframe, a windowframe, or a corner of a room, the user uses haired brush 20 as an auxiliary brush. For this purpose, the user of vacuum cleaner 100 separates floor cleaning unit 110 from rigid wand 132 of hose assembly 130 and inserts haired brush 20 onto rigid wand 132. Thereafter, the user brings haired brush 20 into contact with the recessed surface and sweeps dust or other foreign substances off the recessed surface. Thereby, dust or other foreign substances swept from the recessed surface is sucked into the dust collecting compartment of vacuum cleaner 100.

Next, when the user cleans a variety of indented surfaces such as a sofa, a carpet, or a foot board made of woven goods, the user uses carpet cleaning brush 30 as an auxiliary brush. For this purpose, the user of vacuum cleaner 100 separates floor cleaning unit 110 from rigid wand 132 of hose assembly 130 and inserts carpet cleaning brush 30 onto rigid wand 132. Thereafter, the user brings second end 34 of carpet cleaning brush 30 into contact with the indented surfaces and beats the indented surfaces by using second end 34 having a polygon shape. Thereby, dust or other foreign substances piled up on the indented surfaces is released and is sucked into the dust collecting compartment of vacuum cleaner 100.

As described above, when a user cleans a predetermined surface by using multipurpose auxiliary brushes according to the prior art, floor cleaning unit 110 of vacuum cleaner 100 must be removed. Then, a predetermined auxiliary brush adapted to clean an object and place to be cleaned, must be employed, or a multipurpose auxiliary brush must be replaced during its use with another multipurpose auxiliary brush. Accordingly, there are frequent interruptions during a cleaning job, and the cleaning efficiency decreases. Further, multipurpose auxiliary brushes which are separately formed can be lost during their use.

Korea Patent Application Laid-Open Publication No. 96-13305, which was filed on Oct. 31, 1994 by DAEWOO ELECTRONICS CO., LTD., an assignee of the present invention, and published on May 22, 1996, discloses a multipurpose auxiliary brush for a vacuum cleaner. The multipurpose auxiliary brush is made up of a knife-type brush and a haired brush which are integrated into a single body. In the multipurpose auxiliary brush, the haired brush is slideably mounted on the knife-type brush, thereby the haired brush and the knife-type brush are united in a single body. However, the multipurpose auxiliary brush does not include a carpet cleaning brush.

SUMMARY OF THE INVENTION

The present invention is contrived to solve the foregoing problems. It is an object of the present invention to provide a multipurpose auxiliary brush for complementing a cleaning function of a main brush in a vacuum cleaner so that a user can perform various cleaning jobs by using the vacuum cleaner, regardless of an object and place to be cleaned.

In order to achieve the above object, the present invention provides a multipurpose auxiliary brush for a vacuum cleaner, the multipurpose auxiliary brush comprising:

a first auxiliary brush for complementing a cleaning function of a main brush, the first auxiliary brush being adapted to clean a recessed surface and being mounted on a hose assembly of the vacuum cleaner through an end thereof, and the first auxiliary brush including a front portion and a rear portion, in which the front portion has a first air flow passage formed through an interior of the front portion, and the second portion has a second air flow passage formed through an interior of the rear portion;

a second auxiliary brush for complementing a cleaning function of a main brush, the second auxiliary brush being adapted to clean a recessed surface and being slideably mounted on the front portion, and the second auxiliary brush including a plurality of hairs attached to an end thereof, and a third auxiliary brush for complementing a cleaning function of a main brush, the third auxiliary brush being adapted to clean an indented surface of predetermined woven goods and being slideably mounted on the second auxiliary brush under the state where the second auxiliary brush is mounted on the front portion, the second auxiliary brush including a first semi-circle shaped portion and a second semi-circle shaped portion which are separated from each other.

The front portion includes a first locking groove and a second locking groove for fixing the second auxiliary brush on the front portion when the second auxiliary brush is positioned on the first portion. The first locking groove is formed on an outer periphery of a front end of the first portion, and the second locking groove is formed on an outer periphery of a rear end of the front portion.

A diameter of the rear portion is larger than a diameter of the front portion. A first shoulder is formed between the front portion and the rear portion.

The first air flow passage is pneumatically connected with the second air flow passage. A diameter of the second air flow passage is larger than a diameter of the first air flow passage.

The second auxiliary brush includes a plurality of first protrusions for slideably supporting the third auxiliary brush. The first protrusions are formed on an outer periphery of the second auxiliary brush and extend in the longitudinal direction of the second auxiliary brush. Guide grooves for slideably guiding the third auxiliary brush are formed on upper portions of the first protrusions. Third locking grooves for stopping the third auxiliary brush moving along the guide grooves are formed on front ends of the guide grooves.

The second auxiliary brush includes a first locking protrusion formed on an inner periphery of the second auxiliary brush and extending in the inward direction. The first locking protrusion is selectively inserted into the first locking groove or the second locking groove when the second auxiliary brush is slideably positioned on the first portion.

The second auxiliary brush has a cylindrical-shape, and one side of the second auxiliary brush is cut off.

The first semi-circle shaped portion includes a plurality of first prominences and depressions formed at an inner lower portion of the first semi-circle shaped portion, and includes a plurality of first taper portions formed at an end of the first semi-circle shaped portion. The second semi-circle shaped portion includes a plurality of second prominences and depressions formed at an inner lower portion of the second semi-circle shaped portion, and includes a plurality of second taper portions formed at an end of the second semi-circle shaped portion. A first cut-off portion is formed between the first taper portions, and a second cut-off portion is formed between the second taper portions. A second shoulder is formed at a lower portion of the first taper portion, and a third shoulder is formed at a lower portion of the second taper portion.

The first semi-circle shaped portion includes a plurality of second protrusions formed on an inner periphery of the first semi-circle shaped portion and extending in the longitudinal direction of the first semi-circle shaped portion, and includes a plurality of second locking protrusions formed on an inner periphery of the first taper portion and protruding in the inward direction. The second semi-circle shaped portion includes a plurality of third protrusions formed on an inner periphery of the second semi-circle shaped portion and extending in the longitudinal direction of the second semi-circle shaped portion, and includes a plurality of third locking protrusions formed on an inner periphery of the second taper portion and protruding in the inward direction.

As described above, according to the preferred first embodiment of the present invention, it is possible to obtain a multipurpose auxiliary brush which is made up of a first auxiliary brush, a second auxiliary brush and a third auxiliary brush. Accordingly, a user can perform various cleaning jobs by using a vacuum cleaner having the multipurpose auxiliary brush according to the present invention regardless of an object and place to be cleaned. In addition, when the user uses the multipurpose auxiliary brush as an auxiliary brush, a working realm of the vacuum cleaner is larger than when the conventional auxiliary brush is employed as the auxiliary brush. Further, the cleaning efficiency of the vacuum cleaner is enhanced, and the vacuum cleaner offers convenience to the user.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, the preferred embodiment of the present invention will be explained in more detail with reference to the accompanying drawings.

FIGS. 1 to 7 illustrate a multipurpose auxiliary brush 200 according to a preferred embodiment of the present invention.

Figure 1:
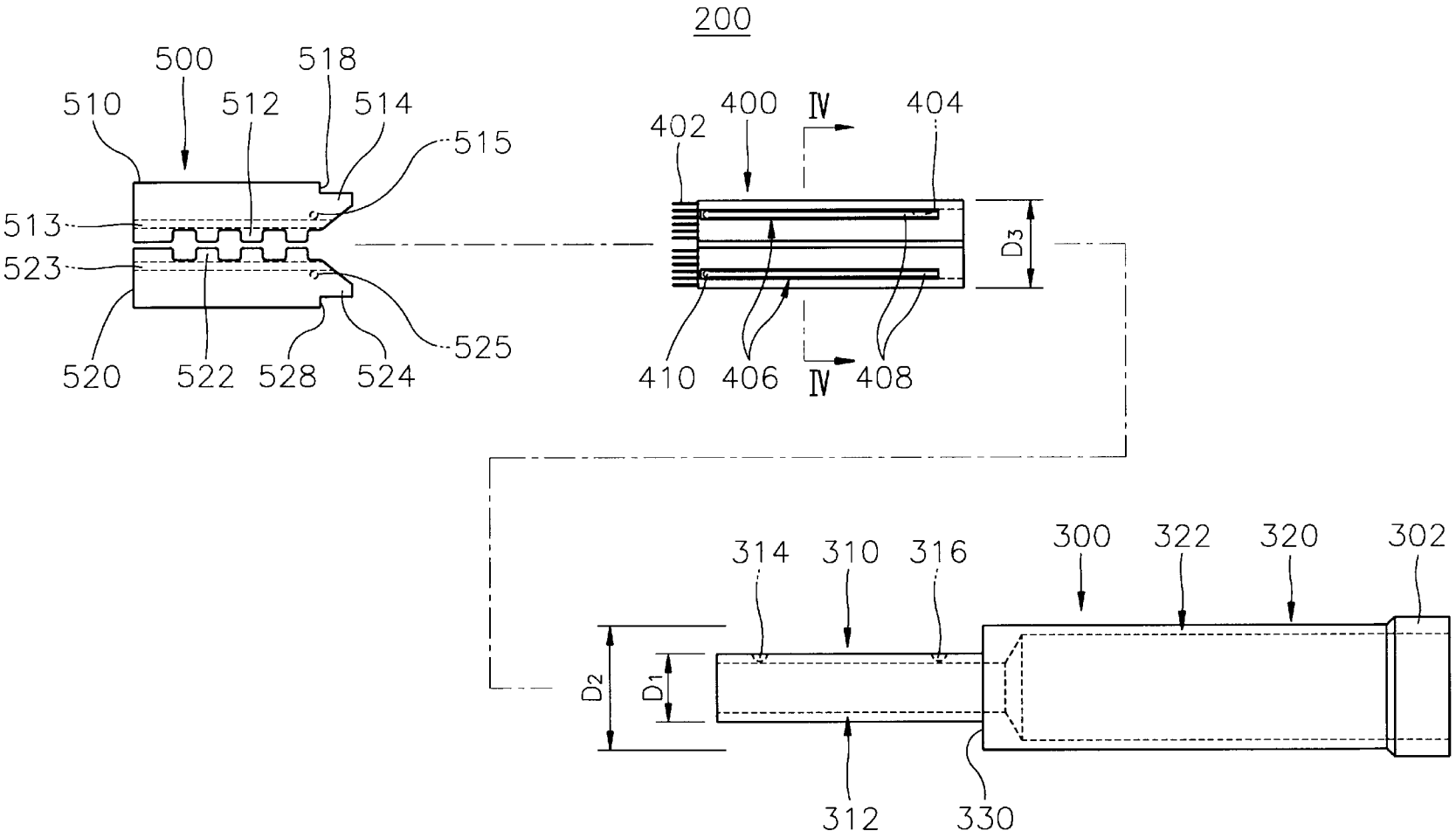
FIG. 1 is an exploded perspective view of a multipurpose auxiliary brush according to a preferred embodiment of the present invention.

First, referring to FIG. 1, multipurpose auxiliary brush 200 includes a knife-type brush 300, a haired brush 400 and a carpet cleaning brush 500.

Figure 8:
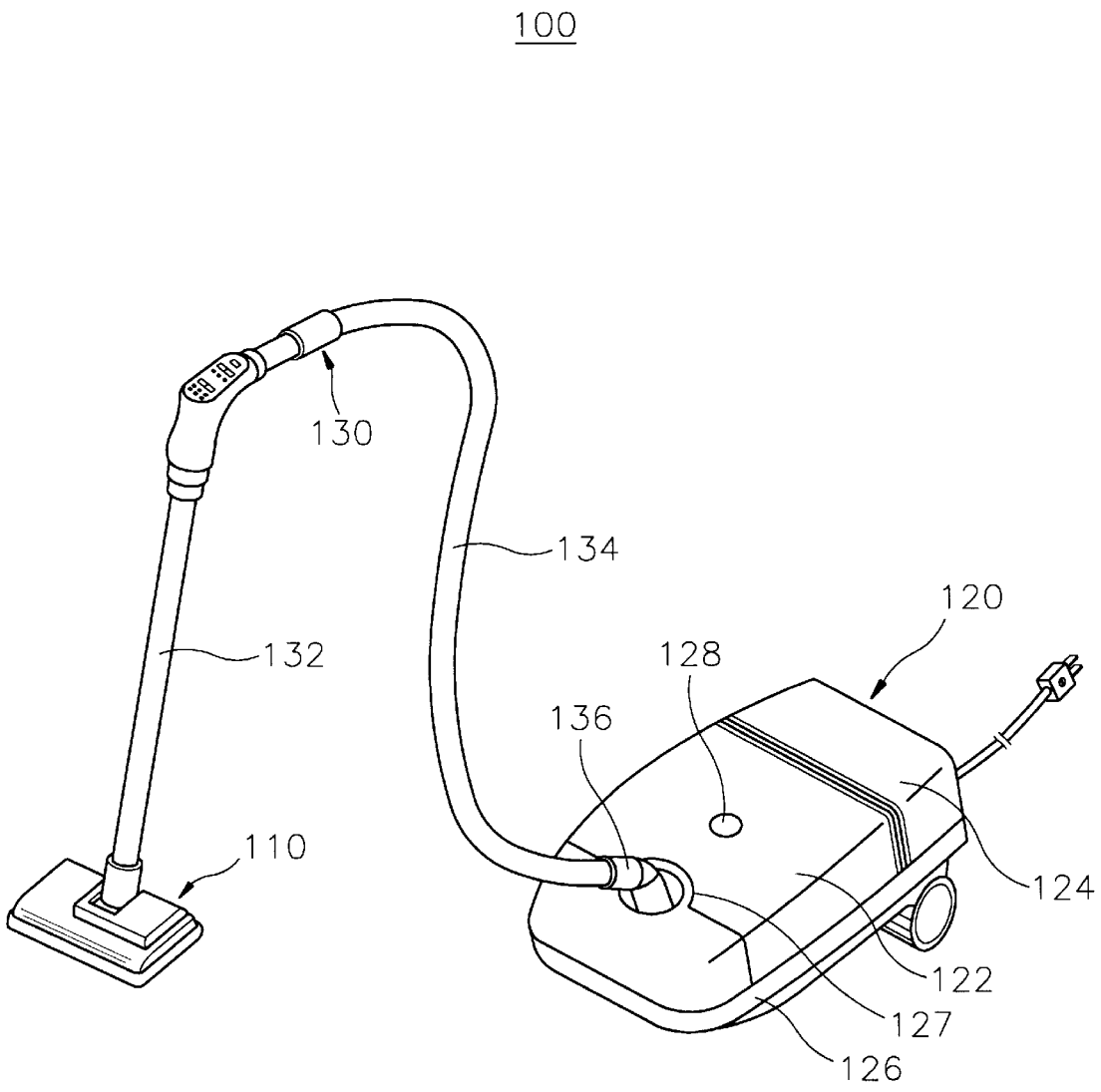
FIG. 8 (PRIOR ART)
FIG. 8 is a perspective view of a canister-type vacuum cleaner according to the prior art.
Figure 9A:
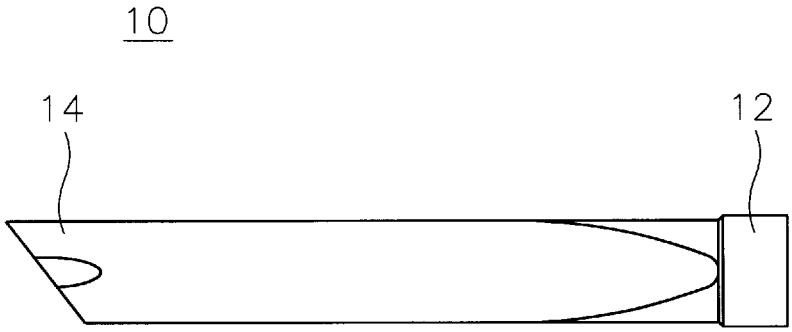
FIG. 9A (PRIOR ART)
FIG. 9A is a perspective view of a knife-type brush according to the prior art.
Figure 9B:
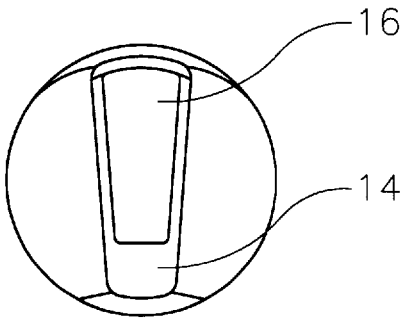
FIG. 9B (PRIOR ART)
FIG. 9B is a left side elevational view of the knife-type brush illustrated in FIG. 9A.
Figure 10A:
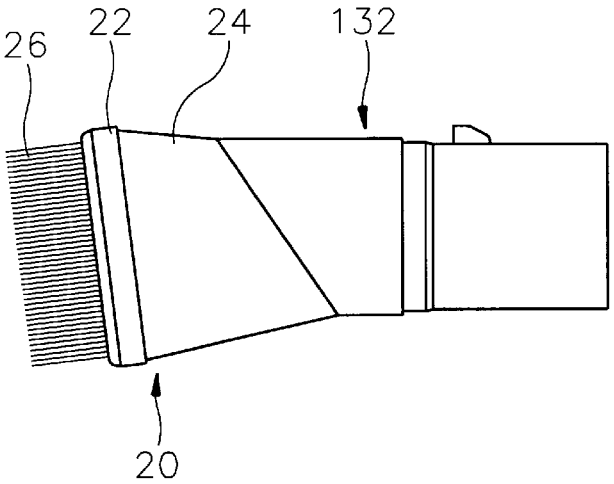
FIG. 10A (PRIOR ART)
FIG. 10A is a perspective view of a haired brush according to the prior art.
Figure 10B:
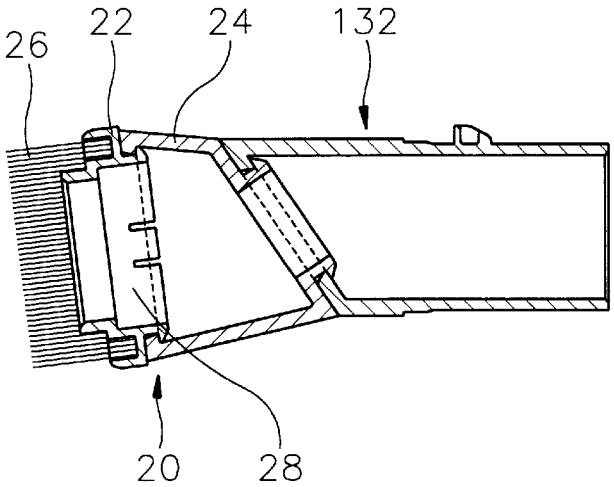
FIG. 10B (PRIOR ART)
FIG. 10B is a longitudinal sectional view of the haired brush illustrated in FIG. 10A.
Figure 11A:
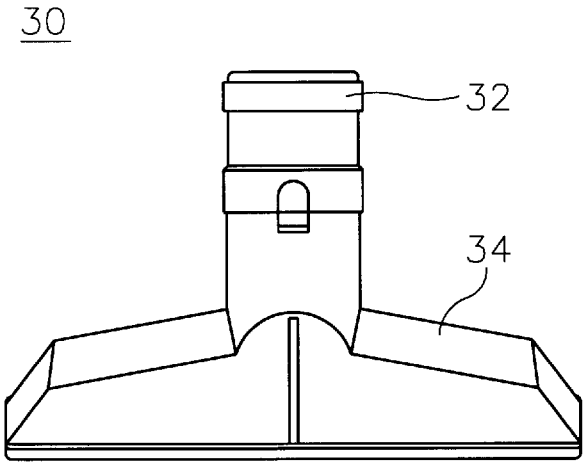
FIG. 11A (PRIOR ART)
FIG. 11A is a perspective view of a carpet cleaning brush according to the prior art.
Figure 11B:
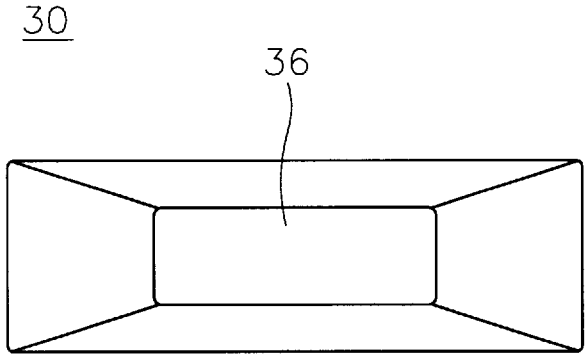
FIG. 11B (PRIOR ART)
FIG. 11B is a bottom plan view of the carpet cleaning brush illustrated in FIG. 11A.

Knife-type brush 300 is adapted to clean a recessed surface on which it is difficult to slideably move floor cleaning unit 110 (referred to FIG. 8). That is, knife-type brush 300 is adapted to clean a recessed surface such as a doorframe, a windowframe, or a corner of a room. An end 302 of knife-type brush 300 is fitted onto rigid wand 132 (referred to FIG. 10) of hose assembly 130. Knife-type brush 300 includes a front portion 310 and a rear portion 320. Front portion 310 has a predetermined diameter $D_1$. A diameter $D_2$ of rear portion 320 is larger than the diameter $D_1$, of front portion 310. Thereby, a first shoulder 330 is formed between front portion 310 and rear portion 320.

Figure 4A:
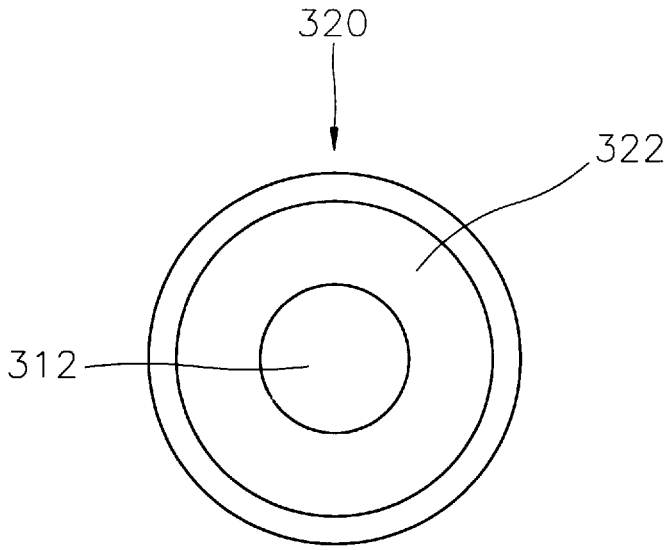
FIG. 4A is a right side elevational view of a knife-type brush illustrated in FIG. 1.

As shown in FIGS. 1 and 4, front portion 310 includes a first air flow passageway 312 formed through an interior of front portion 310. First air flow passageway 312 extends to predetermined place in rear portion 320 beyond first shoulder 330. A first locking groove 314 is formed at an outer periphery of a front end of front portion 310. A second locking groove 316 is formed at an outer periphery of a rear end of front portion 310. Rear portion 320 includes a second air flow passageway 322 formed through an interior of rear portion 320. Preferably, the diameter of second air flow passageway 322 is larger than the diameter of first air flow passageway 312.

Haired brush 400 is adapted to clean a recessed surface on which dust or other foreign substances has piled up, such as a doorframe, a windowframe, or a corner of a room. Haired brush 400 is slideably mounted on front portion 310 of knife-type brush 300. For this purpose, haired brush 400 has a diameter $D_3$ which is larger than a diameter $D_1$, of front portion 310 of knife-type brush 300 and is smaller than a diameter a diameter $D_2$ of rear portion 320.

Figure 4B:
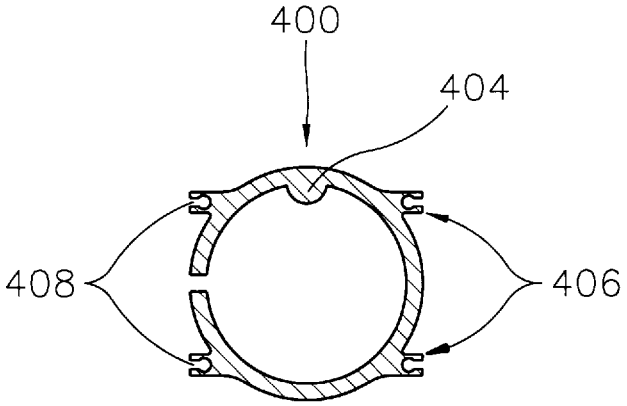
FIG. 4B is a cross-sectional view taken along line IV—IV shown in FIG. 1.

A plurality of hairs 402 made of a synthetic thread are attached to an end of haired brush 400. As shown in FIG. 4B, a first locking protrusion 404 is formed on an inner periphery of haired brush 400. When haired brush 400 is mounted on front portion 320 of knife-type brush 300, first locking protrusion 404 is selectively inserted into first locking groove 314 or second locking groove 316. Thereby, haired brush 400 is fixed on front portion 310 of knife-type brush 300.

As shown in FIGS. 1 and 4B, a plurality of first protrusions 406 for slideably supporting carpet cleaning brush 500 on haired brush 400 are formed on an outer periphery of haired brush 400. First protrusions 406 extend in the longitudinal direction of haired brush 400. Guide slots 408 for slideably guiding carpet cleaning brush 500 are formed on upper portions of first protrusions 406. Third locking grooves 410 are formed on front ends of guide grooves facing a free end of haired brush 400, to which hairs 402 are attached.

Haired brush 400 has a cylindrical-shape, and one side of haired brush 400 is cut off from an other side of haired brush 400 in order to horizontally move haired brush 400 along front portion 310 of knife-type brush 300. That is, since the one side of haired brush 400 is cut off, a user of vacuum cleaner 100 (referred to FIG. 8) can manually enlarge the diameter $D_3$ of haired brush 400. Thereby, first locking protrusion 404 formed in the inner periphery of haired brush 400 is easily released from first locking groove 314 or second locking groove 316, which are formed on the outer periphery of front portion 310.

Carpet cleaning brush 500 is adapted to beat and clean a variety of indented surfaces such as a sofa, a carpet, or a foot board made of woven goods. Carpet cleaning brush 500 includes a first semi-circle shaped portion 510 and a second semi-circle shaped portion 520 which are separated from each other.

Figure 3:
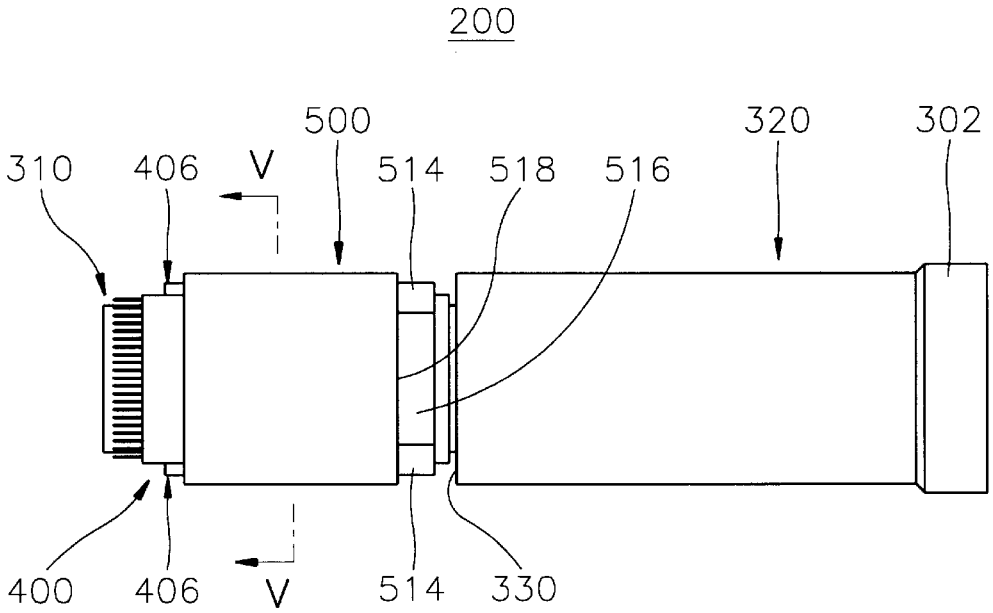
FIG. 3 is a plan view of the multipurpose auxiliary brush illustrated in FIG. 2.

A plurality of first prominences and depressions 512 are formed at an inner lower portion of first semi-circle shaped portion 510. First prominences and depressions 512 can be easily brought into contact with a carpet or a foot board made of woven goods. A plurality of first tapered portions 514 are formed at an end of first semi-circle shaped portion 510. As shown in FIG. 3, a first cut-off portion 516 is formed between first tapered portions 514. When a user cleans the indented surfaces by using carpet cleaning brush 500 (referred to FIG. 7), first cut-off portion 516 makes it possible to vertically arrange first semi-circle shaped portion 510 of carpet cleaning brush 500 without interference from the outer periphery of haired brush 400. A second shoulder 518 is formed at a lower portion of first tapered portion 514 adjacent to first cut-off portion 516.

A plurality of second prominences and depressions 522 are formed at an inner lower portion of second semi-circle shaped portion 520. In the same manner as first prominences and depressions 512, second prominences and depressions 522 can be easily brought into contact with a carpet or a foot board made of woven goods. A plurality of second tapered portions 524 are formed at an end of second semi-circle shaped portion 520. A second cut-off portion 526 is formed between second tapered portions 524. Second cut-off portion 526 is formed symmetrically to first cut-off portion 516 of first semi-circle shaped portion 510, and performs the same function as first cut-off portion 510.

Second tapered portion 524 is formed symmetrically to first tapered portion 514 of first semi-circle shaped portion 510. Third shoulder 528 is formed to the lower portion of second tapered portion 524 adjacent to second cut-off portion. Third shoulder 528 is formed symmetrically to second shoulder 518 of first semi-circle shaped portion 510.

When the user cleans the indented surface by using carpet cleaning brush 500, first tapered portion 514 and second tapered portion 524 prevent carpet cleaning brush 500, which is unfolds in the vertical direction, from folding in the inward direction. That is, when first semi-circle shaped portion 510 and second semi-circle shaped portion 520 of carpet cleaning brush 500 are unfolded in the vertical direction, first tapered portion 514 and second tapered portion 524 are supported against each other. Accordingly, it is possible to prevent carpet cleaning brush 500 from folding in the inward direction.

Figure 5A:
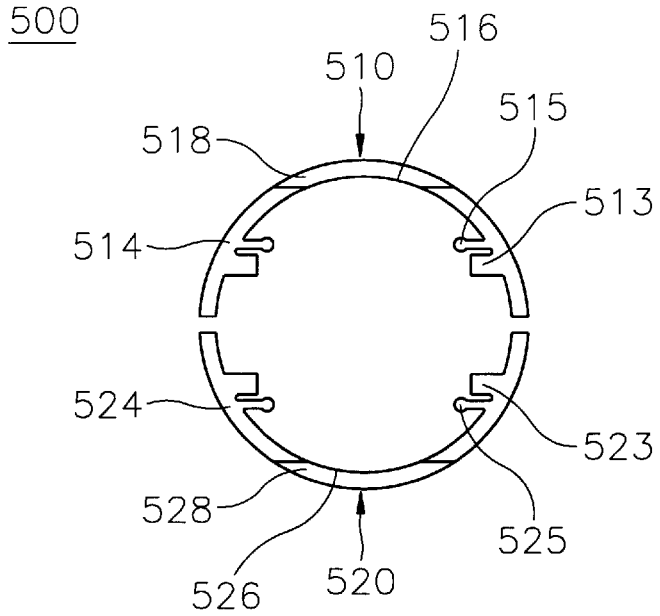
FIG. 5A is a right side elevational view of a carpet cleaning brush illustrated in FIG. 1.

As best shown in FIG. 5A, first semi-circle shaped portion 510 and second semi-circle shaped portion 520 of carpet cleaning brush 500 include a plurality of second protrusions 513 and a plurality of third protrusions 523, respectively. Second protrusions 513 and third protrusions 523 extend in the inward direction along the longitudinal direction of first semi-circle shaped portion 510 and second semi-circle shaped portion 520, respectively.

Figure 5B:
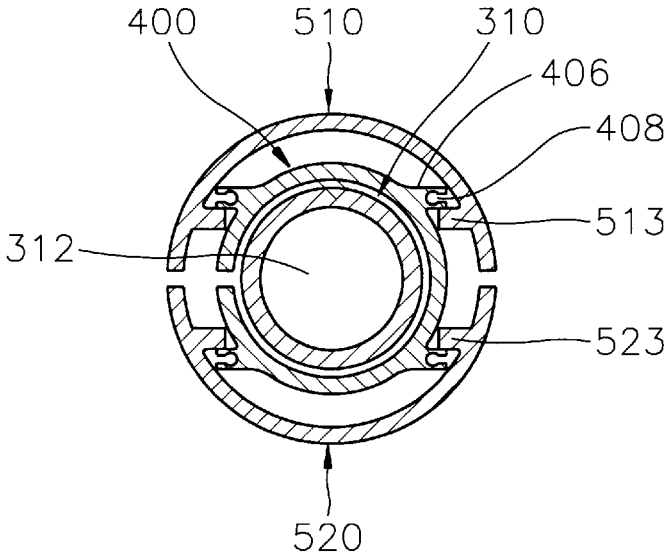
FIG. 5B is a cross-sectional view taken along line V13 V shown in FIG. 3.

As shown in FIG. 5B, when carpet cleaning brush 500 is slideably positioned on haired brush 400, second protrusion 513 and third protrusion 523 engage with first protrusion 406 formed on the outer periphery of haired brush 400. Thereby, first semi-circle shaped portion 510 and second semi-circle shaped portion 520 of carpet cleaning brush 500 are supported and are not released from haired brush 400.

Referring to FIG. 5A again, first semi-circle shaped portion 510 and second semi-circle shaped portion 520 include a plurality of second locking protrusions 515 and a plurality of third locking protrusions 525, respectively. Second locking protrusions 515 protrude in the inward direction from an interior of first tapered portions 514 at a predetermined positions between second protrusions 513. In the same manner as second locking protrusions 515, third locking protrusions 525 protrude in the inward direction from an interior of second tapered portions 524 at predetermined positions between third protrusions 523. When carpet cleaning brush 500 slideably moves on haired brush 400, second locking protrusion 515 and third locking protrusion 525 slideably move along first guide slot 408 formed on first protrusion 406.

The practical application mode of multipurpose auxiliary brush 200 having the above described constitution according to a preferred embodiment of the present invention will be described.

First, when a user of vacuum cleaner 100 cleans a flat bottom surface such as a floor by using vacuum cleaner 100, the user slideably moves floor cleaning unit 110, to which a main brush and a suction nozzle are installed, along a surface to be cleaned and performs a cleaning job.

However, when the user cleans a non-flat surface such as a doorframe, a windowframe, or a corner of a room, a sofa, a carpet, or a foot board made of woven goods, multipurpose auxiliary brush 200 according to the preferred first embodiment of the present invention is employed instead of floor cleaning unit 110, to which the main brush is installed. For this purpose, floor cleaning unit 110 is removed from rigid wand 132 of hose assembly 130, and then end 302 of knife-type brush 300 is fitted onto rigid wand 132 of hose assembly 130. Thereby, multipurpose auxiliary brush 200 is mounted on rigid wand 132.

When the user of vacuum cleaner 100 cleans a recessed surface such as a doorframe, a windowframe, or a corner of a room by using multipurpose auxiliary brush 200, knife-type brush 300 is mainly employed. Because knife-type brush 300 has a contact area with a surface to be cleaned that is smaller than a contact area of floor cleaning unit 110 (referred to FIG. 8), knife-type brush 300 can be easily brought into contact with the recessed surface.

Figure 2:
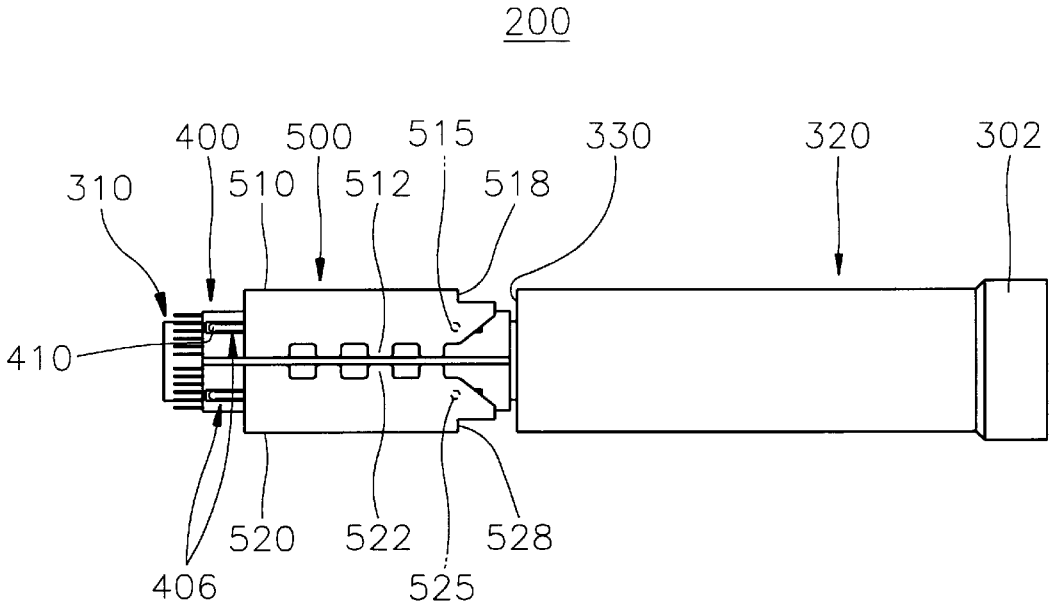
FIG. 2 illustrates an assembled state of the multipurpose auxiliary brush illustrated in FIG. 1.

As illustrated in FIGS. 2 and 3, knife-type brush 300 can be used under the state where haired brush 400 and carpet cleaning brush 500 are positioned on front portion 310 of knife-type brush 300. For this purpose, haired brush 400 is positioned on front portion 310 of knife-type brush 300. That is, haired brush 400 can be positioned on front portion 310 of knife-type brush 300 by inserting first locking protrusion 404 of haired brush 400 into second locking groove 316 of front portion 310.

Thereafter, carpet cleaning brush 500 is positioned on haired brush 400. That is, carpet cleaning brush 500 is positioned on haired brush 400 by engaging second protrusion 513 and third protrusion 523 of carpet cleaning brush 500 with first protrusion 406 of haired brush 400. Under this state, the user moves front portion 310 of knife-type brush 300 along the recessed surface. Thereby, dust or other foreign substances piled up on the recessed surface are sucked into the dust collecting compartment (not shown) of vacuum cleaner 100.

When a user of vacuum cleaner 100 cleans a recessed surface on which dust or other foreign substances has piled up, such as a doorframe, a windowframe, or a corner of a room, by using multipurpose auxiliary brush 200, haired brush 400 is mainly employed. Because similar to knife-type brush 300, haired brush 400 has a contact area with a surface to be cleaned that is smaller than a contact area of floor cleaning unit 110, haired brush 400 can be easily brought contact with the recessed surface, and can be adapted to sweep and clean dust or other foreign substances from the recessed surface to be cleaned.

Figure 6:
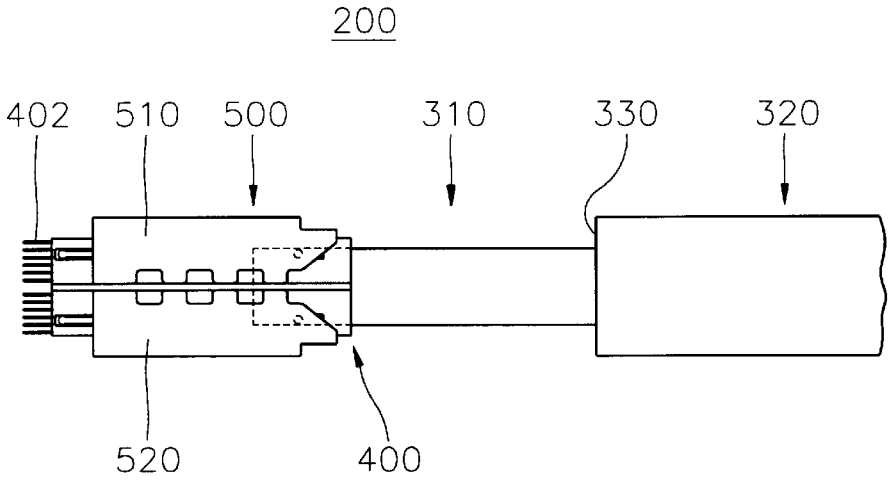
FIG. 6 illustrates an operation state of a haired brush illustrated in FIG. 1.

Haired brush 400 can be used under the state where haired brush 400 protrudes ahead of front portion 310 of knife-type brush 300, as illustrated in FIG. 6. To use haired brush 400, the user of vacuum cleaner 100 manually pushes haired brush 400, which is mounted on front portion 310 of knife-type brush 300, toward front portion 310 while carpet cleaning brush 500 is mounted on haired brush 400. Then, first locking protrusion 404 is released from second locking groove 316 by the force applied by the user of vacuum cleaner 100. Thereby, haired brush 400 can be moved from a rear end of front portion 310 toward a front end of front portion 310.

After haired brush 400 is moved to the front end of front portion 310, haired brush 400 protrudes ahead of front portion 310 and is fixed in this state by inserting first locking protrusion 404 of haired brush 400 into first locking groove 314. Under this state, the user of vacuum cleaner 100 brings haired brush 400 into contact with the recessed surface to be cleaned. As a result, dust or other foreign substances piled up on the recessed surface are swept and sucked into the dust collecting compartment of vacuum cleaner 100.

Meanwhile, when a user of vacuum cleaner 100 cleans a variety of indented surfaces, in other words, non-flat surfaces such as a sofa, a carpet, or a foot board made of woven goods, carpet cleaning brush 500 is mainly employed since carpet cleaning brush 500 is better adapted for beating and cleaning indented surfaces than floor cleaning unit 110.

Figure 7:
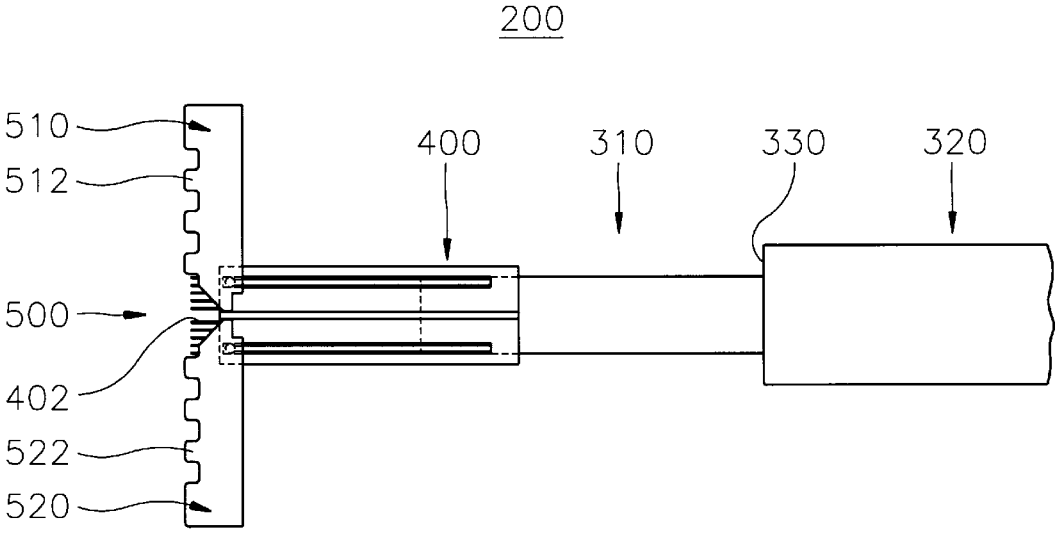
FIG. 7 illustrates an operation state of the carpet cleaning brush illustrated in FIG. 1.

Carpet cleaning brush 500 can be used under the state where haired brush 400 protrudes ahead of front portion 310 of knife-type brush 300, and carpet cleaning brush 500 mounted on haired brush 400 is vertically arranged ahead of haired brush 400, as illustrated in FIG. 7. For this purpose, the user of vacuum cleaner 100 manually pushes haired brush 400, which is mounted on front portion 310 of knife-type brush 300, toward front portion 310 while carpet cleaning brush 500 is mounted on haired brush 400. Then, first locking protrusion 404 is released from second locking groove 316 by the force applied by the user of vacuum cleaner 100. Thereby, haired brush 400 can be moved from a rear end of front portion 310 toward a front end of front portion 310.

That is, second locking protrusion 515 and third locking protrusion 525, which are provided on first semi-circle shaped portion 510 and second semi-circle shaped portion 520 respectively, move on guide slot 408 formed in the upper portion of first protrusion 406. As a result, carpet cleaning brush 500 can slide onto haired brush 400. When second locking protrusion 515 and third locking protrusion 525 reach third locking groove 410 formed on a front end of guide slot 408, first semi-circle shaped portion 510 and second semi-circle shaped portion 520 are symmetrically arranged in the vertical direction by the force applied by the user of vacuum cleaner 100. At this time, first semi-circle shaped portion 510 and second semi-circle shaped portion 520 are fixed in the upright state by making contact with first tapered portion 514 with second tapered portion 524, respectively.

If first semi-circle shaped portion 510 and second semi-circle shaped portion 520 of carpet cleaning brush 500 are arranged completely vertically, the user of vacuum cleaner 100 beats and cleans indented surfaces such as a sofa, a carpet, or a foot board made of woven goods by using carpet cleaning brush 500 protruding ahead of haired brush 400. Thereafter, dust or other foreign substances released from the indented surfaces are sucked into the dust collecting compartment of vacuum cleaner 100.

As described above, according to the preferred first embodiment of the present invention, it is possible to obtain multipurpose auxiliary brush 200, which is made up of knife-type brush 300, haired brush 400 and carpet cleaning brush 500. Accordingly, a user can perform various cleaning jobs by using a vacuum cleaner 100 having multipurpose auxiliary brush 200, regardless of an object and place to be cleaned. In addition, when the user uses multipurpose auxiliary brush 200 as an auxiliary brush, a working realm of vacuum cleaner 100 is larger than when knife-type brush 10, haired brush 20 and carpet cleaning brush 30 according to the prior art are employed as the auxiliary brush. Further, the cleaning efficiency of vacuum cleaner 200 is enhanced, and vacuum cleaner 200 offers convenience to the user.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A multipurpose auxiliary brush for a vacuum cleaner, said multipurpose auxiliary brush comprising:

a first auxiliary brush for complementing a cleaning function of a main brush, said first auxiliary brush being adapted to clean a recessed surface and being mounted on a hose assembly of the vacuum cleaner through an end thereof, and said first auxiliary brush including a front portion and a rear portion, in which said front portion has a first air flow passage formed through an interior of said front portion, and said rear portion has a second air flow passage formed through an interior of said rear portion;

a second auxiliary brush for complementing a cleaning function of a main brush, said second auxiliary brush being adapted to clean a recessed surface and being slideably mounted on said front portion, and said second auxiliary brush including a plurality of hairs attached to an end thereof; and a third auxiliary brush for complementing a cleaning function of a main brush, said third auxiliary brush being adapted to clean an indented surface of predetermined woven goods and being slideably mounted on said second auxiliary brush under the state where said second auxiliary brush is mounted on said front portion, said third auxiliary brush including a first semi-circle shaped portion and a second semi-circle shaped portion which are separated from each other.

2. A multipurpose auxiliary brush as claimed in claim 1, wherein said front portion includes a first locking groove and a second locking groove for fixing said second auxiliary brush on said front portion when said second auxiliary brush is positioned on said first portion, said first locking groove being formed on an outer periphery of a front end of said first portion, and said second locking groove being formed on an outer periphery of a rear end of said front portion.

3. A multipurpose auxiliary brush as claimed in claim 1, wherein a diameter of said rear portion is larger than a diameter of said front portion, and a first shoulder is formed between said front portion and said rear portion.

4. A multipurpose auxiliary brush as claimed in claim 1, wherein said first air flow passage is pneumatically connected with said second air flow passage, and a diameter of said second air flow passage is larger than a diameter of said first air flow passage.

5. A multipurpose auxiliary brush as claimed in claim 1, wherein said second auxiliary brush includes a plurality of first protrusions for slideably supporting said third auxiliary brush, and said first protrusions are formed on an outer periphery of said second auxiliary brush and extend in the longitudinal direction of said second auxiliary brush.

6. A multipurpose auxiliary brush as claimed in claim 5, wherein guide grooves for slideably guiding said third auxiliary brush are formed on upper portions of said first protrusions.

7. A multipurpose auxiliary brush as claimed in claim 6, wherein third locking grooves for stopping said third auxiliary brush moving along said guide grooves are formed on front ends of said guide grooves.

8. A multipurpose auxiliary brush as claimed in claim 1, wherein said second auxiliary brush includes a first locking protrusion formed on an inner periphery of said second auxiliary brush and extending in the inward direction, and said first locking protrusion is selectively inserted into said first locking groove or said second locking groove when said second auxiliary brush is slideably positioned on said first portion.

9. A multipurpose auxiliary brush as claimed in claim 1, wherein said second auxiliary brush has a cylindrical-shape, and one side of said second auxiliary brush is cut off.

10. A multipurpose auxiliary brush as claimed in claim 1, wherein said first semi-circle shaped portion includes a plurality of first prominences and depressions formed at an inner lower portion of said first semi-circle shaped portion, and includes a plurality of first taper portions formed at an end of said first semi-circle shaped portion, and said second semi-circle shaped portion includes a plurality of second prominences and depressions formed at an inner lower portion of said second semi-circle shaped portion, and includes a plurality of second taper portions formed at an end of said second semi-circle shaped portion.

11. A multipurpose auxiliary brush as claimed in claim 10, wherein a first cut-off portion is formed between said first taper portions, and a second cut-off portion is formed between said second taper portions.

12. A multipurpose auxiliary brush as claimed in claim 10, wherein a second shoulder is formed at a lower portion of said first taper portion, and a third shoulder is formed at a lower portion of said second taper portion.

13. A multipurpose auxiliary brush as claimed in claim 1, wherein said first semi-circle shaped portion includes a plurality of second protrusions formed on an inner periphery of said first semi-circle shaped portion and extending in the longitudinal direction of said first semi-circle shaped portion, and includes a plurality of second locking protrusions formed on an inner periphery of said first taper portion and protruding in the inward direction, and said second semi-circle shaped portion includes a plurality of third protrusions formed on an inner periphery of said second semi-circle shaped portion and extending in the longitudinal direction of said second semi-circle shaped portion, and includes a plurality of third locking protrusions formed on an inner periphery of said second taper portion and protruding in the inward direction.

14. A multipurpose auxiliary brush for a vacuum cleaner, said multipurpose auxiliary brush comprising:

(a) a first auxiliary brush for complementing a cleaning function of a main brush, said first auxiliary brush being adapted to clean a recessed surface and being mounted on a hose assembly of the vacuum cleaner through an end thereof, and said first auxiliary brush including a front portion and a rear portion, in which said front portion has a first air flow passage formed through an interior of said front portion, and said rear portion has a second air flow passage formed through an interior of said rear portion, and said front portion includes a first locking groove and a second locking groove, said first locking groove is formed on an outer periphery of a front end of said first portion, and said second locking groove is formed on an outer periphery of a rear end of said front portion, and a diameter of said rear portion is larger than a diameter of said front portion, and a first shoulder is formed between said front portion and said rear portion;

(b) a second auxiliary brush for complementing a cleaning function of a main brush, said second auxiliary brush being adapted to clean a recessed surface and being slideably mounted on said front portion, and said second auxiliary brush including a plurality of hairs attached to an end thereof, and including a plurality of first protrusions, and including a first locking protrusion formed on an inner periphery of said second auxiliary brush and extending in the inward direction, in which said first protrusions are formed on an outer periphery of said second auxiliary brush and extending in the longitudinal direction of said second auxiliary brush, and said first locking protrusion is selectively inserted into said first locking groove or said second locking groove when said second auxiliary brush is slideably positioned on said first portion; and (c) a third auxiliary brush for complementing a cleaning function of a main brush, said third auxiliary brush being adapted to clean an indented surface of predetermined woven goods and being slideably mounted on said second auxiliary brush under the state where said second auxiliary brush is mounted on said front portion, said third auxiliary brush including a first semi-circle shaped portion and a second semi-circle shaped portion which are separated from each other, in which said first semi-circle shaped portion includes a plurality of first prominences and depressions formed at an inner lower portion of said first semi-circle shaped portion, and includes a plurality of first taper portions formed at an end of said first semi-circle shaped portion, and said second semi-circle shaped portion includes a plurality of second prominences and depressions formed at an inner lower portion of said second semi-circle shaped portion, and includes a plurality of second taper portions formed at an end of said second semi-circle shaped portion, and a first cut-off portion is formed between said first taper portions, and a second cut-off portion is formed between said second taper portions.

15. A multipurpose auxiliary brush as claimed in claim 14, wherein said first air flow passage is pneumatically connected with said second air flow passage, and a diameter of said second air flow passage is larger than a diameter of said first air flow passage.

16. A multipurpose auxiliary brush as claimed in claim 14, wherein guide grooves for slideably guiding said third auxiliary brush are formed on upper portions of said first protrusions.

17. A multipurpose auxiliary brush as claimed in claim 16, wherein third locking grooves for stopping said third auxiliary brush moving along said guide grooves are formed on front ends of said guide grooves.

18. A multipurpose auxiliary brush as claimed in claim 14, wherein said second auxiliary brush has a cylindrical-shape, and one side of said second auxiliary brush is cut off.

19. A multipurpose auxiliary brush as claimed in claim 14, wherein a second shoulder is formed at a lower portion of said first taper portion, and a third shoulder is formed at a lower portion of said second taper portion.

20. A multipurpose auxiliary brush for a vacuum cleaner, said multipurpose auxiliary brush comprising:

(a) a first auxiliary brush for complementing a cleaning function of a main brush, said first auxiliary brush being adapted to clean a recessed surface and being mounted on a hose assembly of the vacuum cleaner through an end thereof, and said first auxiliary brush including a front portion and a rear portion, in which said front portion has a first air flow passage formed through an interior of said front portion, and said rear portion has a second air flow passage formed through an interior of said rear portion, and said front portion includes a first locking groove and a second locking groove, said first locking groove is formed on an outer periphery of a front end of said first portion, and said second locking groove is formed on an outer periphery of a rear end of said front portion, and a diameter of said rear portion is larger than a diameter of said front portion, and a first shoulder is formed between said front portion and said rear portion, and said first air flow passage is pneumatically connected with said second air flow passage, and a diameter of said second air flow passage is larger than a diameter of said first air flow passage;

(b) a second auxiliary brush for complementing a cleaning function of a main brush, said second auxiliary brush being adapted to clean a recessed surface and being slideably mounted on said front portion, and said second auxiliary brush including a plurality of hairs attached to an end thereof, and including a plurality of first protrusions, and including a first locking protrusion formed on an inner periphery of said second auxiliary brush and extending in the inward direction, in which said first protrusions are formed on an outer periphery of said second auxiliary brush and extending in the longitudinal direction of said second auxiliary brush, and said first locking protrusion is selectively inserted into said first locking groove or said second locking groove when said second auxiliary brush is slideably positioned on said first portion, and guide grooves are formed on upper portions of said first protrusions, and third locking grooves are formed on front ends of said guide grooves, and said second auxiliary brush has a cylindrical-shape, and one side of said second auxiliary brush is cut off; and (c) a third auxiliary brush for complementing a cleaning function of a main brush, said third auxiliary brush being adapted to clean an indented surface of predetermined woven goods and being slideably mounted on said second auxiliary brush under the state where said second auxiliary brush is mounted on said front portion, said third auxiliary brush including a first semi-circle shaped portion and a second semi-circle shaped portion which are separated from each other, in which said first semi-circle shaped portion includes a plurality of first prominences and depressions formed at an inner lower portion of said first semi-circle shaped portion, and includes a plurality of first taper portions formed at an end of said first semi-circle shaped portion, and said second semi-circle shaped portion includes a plurality of second prominences and depressions formed at an inner lower portion of said second semi-circle shaped portion, and includes a plurality of second taper portions formed at an end of said second semi-circle shaped portion, and a first cut-off portion is formed between said first taper portions, and a second cut-off portion is formed between said second taper portions, and a second shoulder is formed at a lower portion of said first taper portion, and a third shoulder is formed at a lower portion of said second taper portion.

* * * * *